US006702895B1

(12) United States Patent
Lazaro

(10) Patent No.: US 6,702,895 B1
(45) Date of Patent: Mar. 9, 2004

(54) RIBBED ELECTROPLATING BARREL

(75) Inventor: Anton E Lazaro, Park Ridge, IL (US)

(73) Assignee: Hardwood Line Manufacturing Co., Chicago, IL (US)

( * ) Notice: Subject to any disclaimer, the term of this patent is extended or adjusted under 35 U.S.C. 154(b) by 330 days.

(21) Appl. No.: 09/951,293

(22) Filed: Sep. 11, 2001

(51) Int. Cl.[7] ..... B05C 3/00
(52) U.S. Cl. ..... 118/418; 204/213
(58) Field of Search ..... 118/417, 418, 118/19, 421; 204/297.11, 297.12, 213, 214, 279; 69/30; 427/242; 366/219

(56) References Cited

U.S. PATENT DOCUMENTS 3,472,753 A 10/1969 Wojtanek
3,479,271 A * 11/1969 Sandrock
3,767,554 A * 10/1973 Noonan
3,936,985 A 2/1976 Marulli
4,014,774 A * 3/1977 Noonan
4,018,427 A * 4/1977 Marulli
5,639,306 A 6/1997 Gradowski
5,651,866 A * 7/1997 Gradowski

* cited by examiner

*Primary Examiner*—Brenda A. Lamb

(57) ABSTRACT

An electroplating barrel holds items to be electroplated while permitting the passage of electroplating solution into and out of the barrel. The solution enters the barrel through small perforations in the sidewalls of the barrel and then is circulated by the rotation of the barrel in an electroplating bath. In this invention the circulation of the electroplating solution, and thus the efficiency of the electroplating process, is increased by directing the flow of the electroplating solution into and out of the barrel through the use of a support rib structure defining perforated sections in the shape of parallelograms. Also, within those parallelogram shaped sections, the utilization of parallel, elongated openings defined by support segments further encourages the multidirectional flow of electroplating solution. The access doors, through the use of an improved locking mechanism also utilize an identical rib support structure with elongated openings.

9 Claims, 4 Drawing Sheets

RIBBED ELECTROPLATING BARREL

BACKGROUND OF THE INVENTION

The present invention relates to electroplating barrels, and in particular to a design for a barrel having side panels and an access door with an improved locking mechanism utilizing a unique combination of support ribs and elongated perforations which encourage efficient circulation of the electroplating solution.

The use of polygonal shaped barrels, and particularly hexagonal shaped barrels is well known in the prior art. These barrels generally include an access point on one side of the barrel for putting the material to be electroplated into the barrel and then removing it after the process has been completed. This process is usually accomplished by dipping the barrel into a bath of electroplating solution and then running an electric current through the barrel while rotating the barrel on an axis.

The passage of the solution into the barrel has generally been accomplished by either the use of a chemically inert mesh fabric as seen in U.S. Pat. No. 3,472,753, or through the use of small circular or square perforations in a solid chemically inert panel as seen in U.S. Pat. Nos. 3,936,985 and 5,639,306.

However, these barrels have been generally used in an industrial setting where rough handling is commonplace and the barrels must repeatedly sustain such treatment. As a consequence the mesh design was unable to effectively deal with these repeated stresses. This problem has been addressed by utilizing a combination of rib segments where at each intersection one such segments ends with the small circular perforation discussed above as seen in U.S. Pat. No. 5,639,306.

However, in that device, along with all other prior art, the problem of maintaining efficient circulation of electroplating solution while minimizing the capillary effect, also known as "drag-out", produced through the utilization of circular openings has played a secondary role to the maintenance of the structural stability of the barrel. Considering that problem, it is an object of the present invention that the "drag-out" of solution is minimized while the barrel still possesses a rib structure and door locking mechanism that can withstand the rigors of a manufacturing environment.

It is another object of the invention to utilize a support rib structure and door locking mechanism that will withstand the rigors of manufacturing while increasing the circulation of electroplating solution in the electroplating tank, thus increasing efficiency of the electroplating process.

It is a further object of the invention to design a side panel which will allow for easy replacement and introduction into the manufacturing environment.

SUMMARY OF THE INVENTION

This invention comprises a rotatable barrel for holding objects to be electroplated having at least one perforated side panel that permits the efficient transfer of electroplating solution into and out of the barrel with minimal "drag out" effect. The design of the side panel includes a base along with a support rib structure that defines sections of the panel that are the shape of a parallelogram. Within the parallelogram shaped section are elongated and cross segments that define elongated perforations, which allow the solution to enter and exit the barrel while retaining the electroplated pieces inside. The barrel preferably is constructed of a chemically inert material. The interior of the barrel, that is the side of the panel opposite the ribs can, be either smooth or uneven.

The support ribs run generally in the direction of the length and the width of the panel but with the ribs laid out so that the intersection points of the ribs always form complementary obtuse and acute angles with each other. The side of the panel opposite the ribs can be either smooth or uneven. In one embodiment the lengthwise ribs, also called longitudinal ribs, run parallel with the length edge of the panel, while the width ribs, also called cross ribs, run approximately 20° from parallel with the width edge of the panel. In another embodiment this arrangement could be switched so that the cross ribs run parallel with the width edge and the longitudinal ribs are angled to create the parallelogram shape. Increasing or decreasing the angle of the cross ribs could also modify the arrangement.

Circulation of the electroplating solution within the bath and the barrel has previously been directed by the rotation of the barrel in the bath. This rotation encouraged circulation only in primarily one direction. The angled arrangement of the ribs in this invention increases this circulation by directing the flow of the solution into and out of the barrel at an angle corresponding to the angle of the cross ribs. This creates a multi-directional circulation pattern within the tank and the barrel that corresponds to an increase in efficiency of electroplating. This efficiency is further enhanced by the utilization of access doors with an improved locking mechanism that enables the access doors to share an identical type of support rib structure.

This increase in circulation is also affected by the arrangement of the perforations within the parallelogram shaped sections. Prior barrels designs have generally utilized small square or circular holes through which the electroplating solution can pass into and out of the barrel, which, even when utilizing thin perforated plates, can lead to a large "drag out" of solution when the barrel is removed from the bath. The current invention reduces this "drag out" by increasing the size of the perforations so that less solution will remain. As the size of the perforations increases the likelihood of solution remaining trapped within the perforations decreases since it is more likely that the surface tension of the solution holding the solution to the opening will be overcome by gravity in the larger area.

In the past these perforations have always been small and usually circular due to concerns of the strength of the panel wall. This invention utilizes support segments arranged generally parallel to each other that define a pattern of rows of elongated openings. The elongated openings serve two purposes: 1) they decrease the "drag out" effect through their larger volume and 2) they increase the circulation of electroplating solution within the barrel by having the elongated perforations run parallel with one of the two directions of ribs. In another embodiment the support segments are interconnected by cross segments that serve to further strengthen the parallelogram shaped section.

It is the combination of these elements, the parallelogram shaped sections defined by support ribs and the parallel running elongated perforations within the parallelogram sections, that enable this invention to be the most efficient. However, either on their own are enough to increase efficiency of the electroplating process.

Furthermore, the barrel in this invention utilizes an improved door locking mechanism utilizing a crossbar with locking spherical rollers that enable the crossbar to be moved and secured into locked and unlocked positions. This removable door also utilizes the abovedescribed parallelogram shaped sections with elongated openings to increase electroplating solution circulation within the barrel.

DETAILED DESCRIPTION OF THE PREFERRED EMBODIMENT

In describing the preferred embodiments of the invention, reference will be made herein to FIGS. 1–7 of the drawings in which like numerals refer to like features of the invention.

Figure 1:
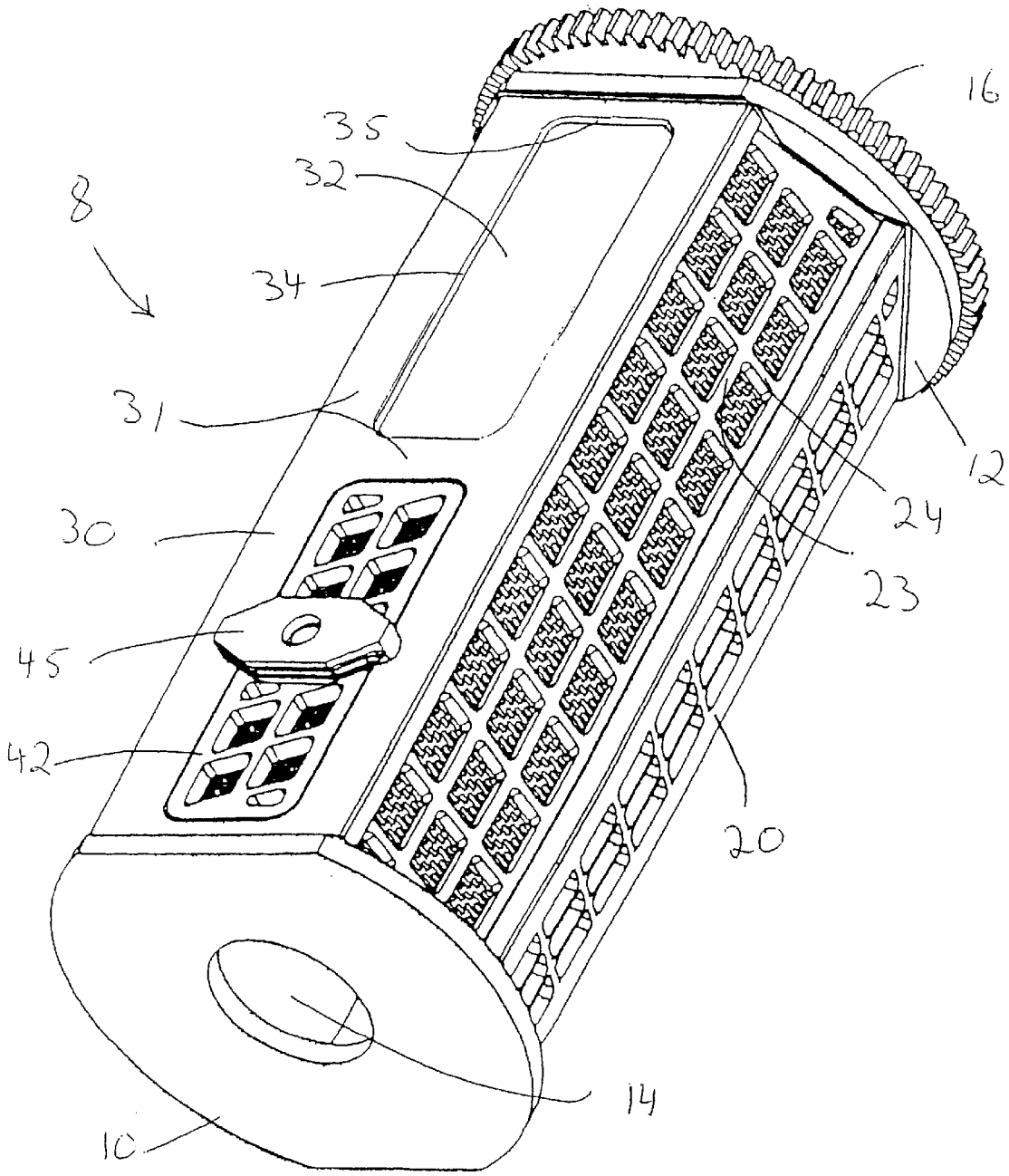
FIG. 1 is a perspective view of the barrel with one access door removed.

Referring to the drawings, electroplating barrel 8 is constructed in accordance with the present invention as shown in FIG. 1. The specific design of barrel 8 includes a plurality of perforated side panels 20 longitudinally spanning the distance between the end plates 10, 12 with each perforated side panel 20 of the barrel 8 employing a configuration of longitudinal ribs 23 and cross ribs 24 that support each perforated section and define the shape as that of a parallelogram and at least one door panel 30. All of theses pieces being preferably constructed of a chemically inert durable polymer that is impact-resistant.

Figure 4:
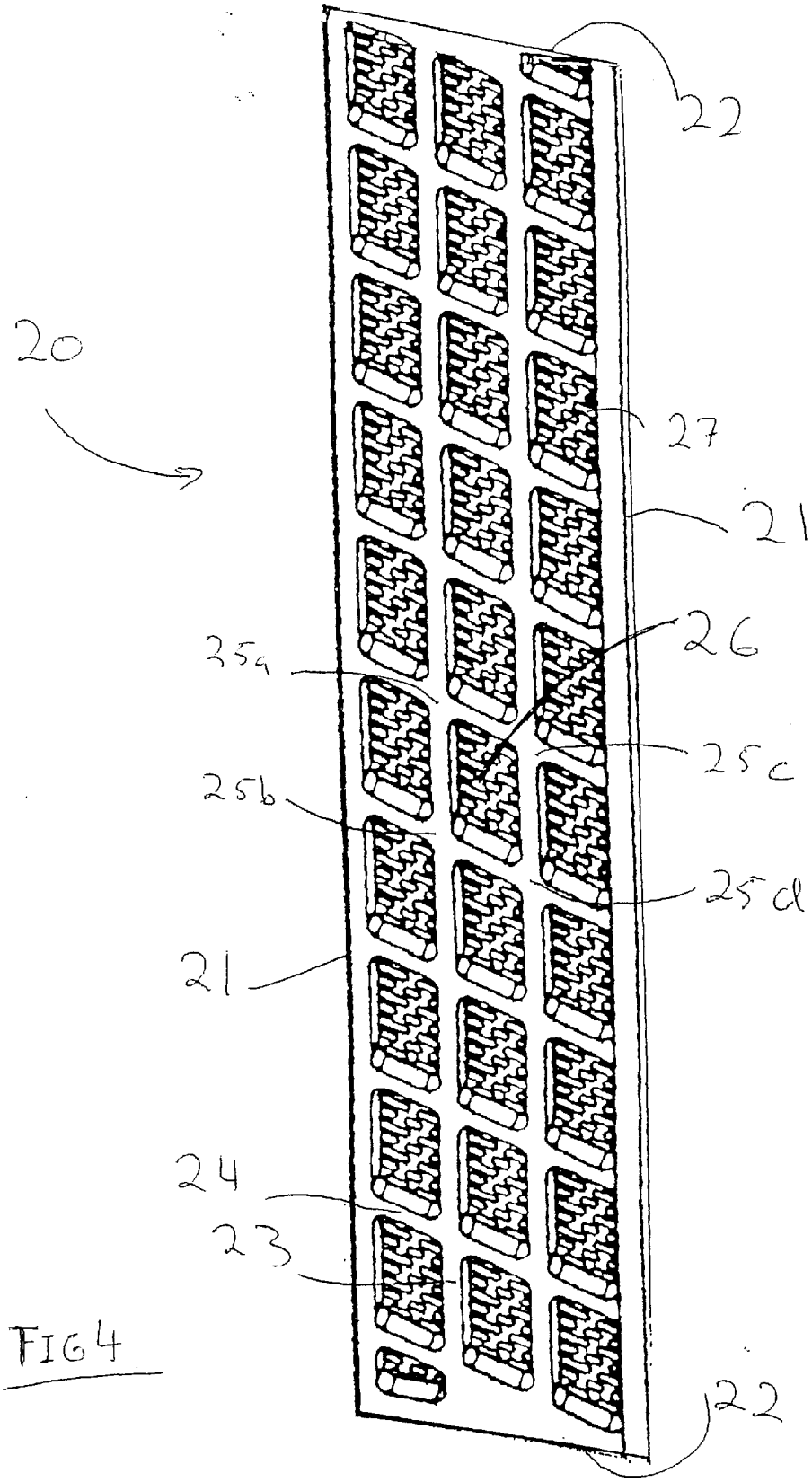
FIG. 4 is an enlarged perspective view of a side panel of the barrel.

The preferred embodiment of the present invention is shown in FIG. 1. The electroplating barrel 8 includes a plurality of perforated side panels 20 and at least one door panel 30. Side panel 20 has longitudinal sides 21 and width sides 22 as shown in FIG. 4. Such panels may be separately mounted whereby they are fixedly associated to collectively form a polygonal barrel with at least one door panel. Such panels my also form a solid one-piece plurality of panels, either configuration being known in the prior art. The door panel 30 further comprises door ribs 31 which define rectangular door openings 32, into which fit access doors 41, 42 as shown in FIG. 1.

The longitudinal side 21 of the side panel 20 may be secured to the longitudinal side 21 of another panel 20 or the door panel 30 by means of adhesive or any other means known in the art. The end sides may be secured to the end plates 10, 12 by similar means. End plates 10,12 have a circular center opening 14 for mounting onto a suspension and drive mechanism for use in the plating tank (not shown). Further, end plate 12 is attached to a geared plate 16, which engages with an intermediate gear to facilitate the rotation of the barrel during the electroplating operation (not shown).

Figure 5:
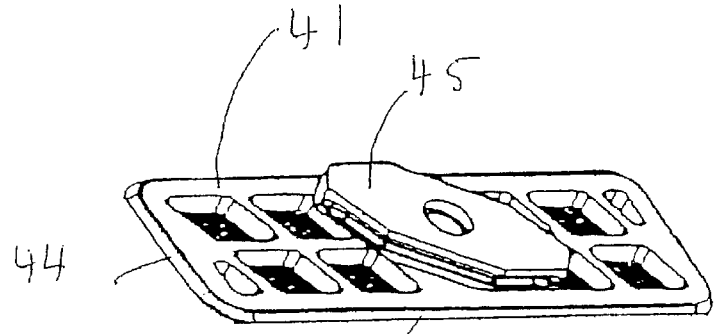
FIG. 5 is a perspective view of an access door removed from the barrel.
Figure 6:
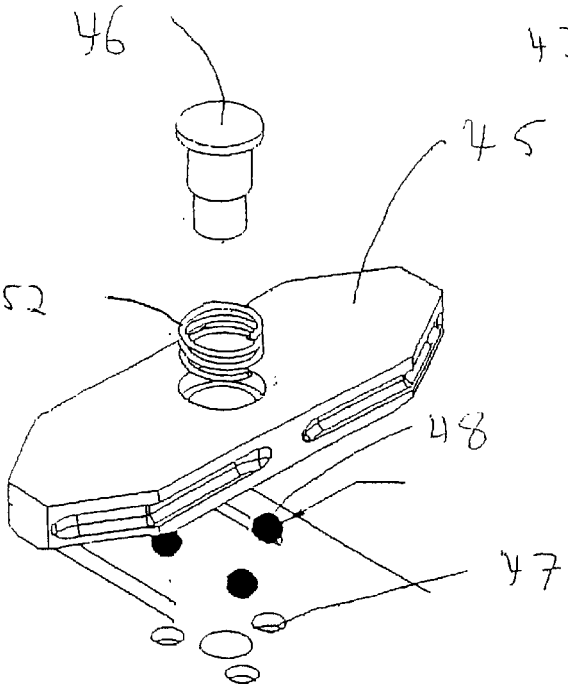
FIG. 6 in an enlarged view of the center top portion of an access door and a crossbar with the spring mounted post removed.
Figure 7:
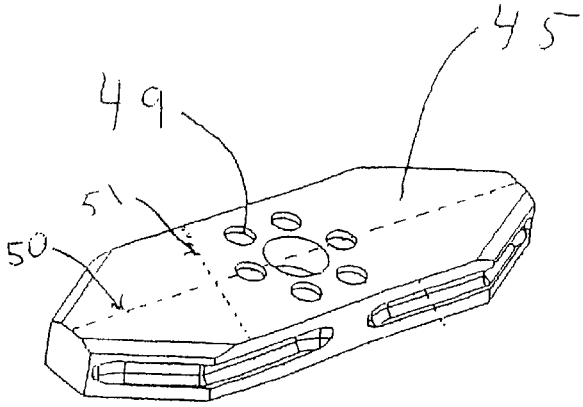
FIG. 7 is the underside of a crossbar showing the annular indentations thereon.

Removable access doors 41, 42, preferably made of a chemically inert durable polymer, have dimensions that fit into the rectangular door openings 32,33 as shown in FIG. 1. The length 43 and width 44 edges of the access doors 41,42, as shown in FIG. 5, are angled such that they complimentary mate with the interior edges 34, 35 of the rectangular door openings 32, 33, as shown in FIG. 1. Access doors 41, 42 each further comprise a locking crossbar 45, which is rotatably attached to the center of the access door by means of a spring-mounted post 46, with the length 50, as seen in FIG. 7, of the crossbar 45, being longer than the width edge 44 of the access doors 41, 42 and the width 51 of the crossbar 45 being shorter than the width 34 of the door panel 30. The side of the removable door 41,42 facing outward further has three annular indentations 47 formed thereon, being spaced equally from the spring-mounted post 46 and from each other, and of a complimentary diameter to receive spherical rollers 48. The underside of the crossbar 45, as seen in FIG. 7, has six annular indentations 49 spaced equally from the spring-mounted post 46 and from each other and have diameter complimentary to the spherical rollers 48. The remaining surface of the access doors 41,42 have an identical structure parallelogram shaped opening as the side panels which are described below.

Figure 2:
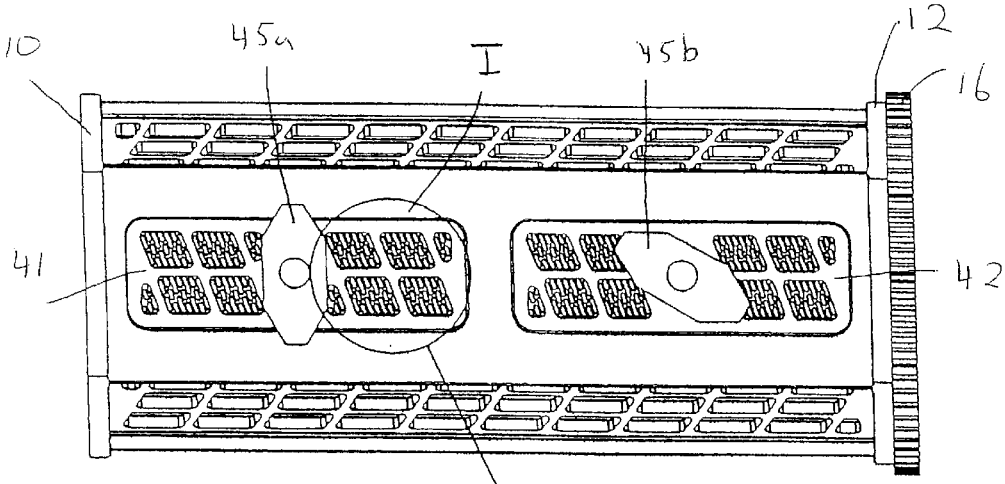
FIG. 2 is an overhead view of the barrel.

By rotating the locking crossbar 45 into a position so that the length 50 of the crossbar is substantially parallel with the end plates 10, 12, as seen in FIG. 2, locking crossbar 45*a*, in combination with the mated edges 43,44 and 34,35, as seen in FIGS. 1 and 5 respectively, the access door is in the locked position and cannot be pushed down into the interior of the barrel 8. In this locked position the spherical rollers 48 are secured in their access door indentations 47 and three of the cross bar indentations 49. Then, by the operator (not shown) turning the locking crossbar 45 into a position where the locking member does not cross edge 43, as seen in FIG., 2 locking crossbar 45*b*, the access door 41, 42 are in the unlocked position and can be removed by moving the access door 41, 42 into the interior of the barrel 8, rotating the access door 41, 42 and lifting the access door 41, 42 through the rectangular door opening 32, 33. During that turning of the crossbar 45, the crossbar is lifted from the spherical rollers 48 by compressing the spring 52 of the spring mounted post 46 and the cross bar is rotated until the spherical rollers 48 are in alignment with the next annular indentations 49 of the crossbar and released whereby the spring 52, pushes crossbar 45 down and into the unlocked position. The spherical rollers 48 due to their rounded nature enable the operator to easily, compared to prior locking mechanisms, rotate the crossbar 52, yet still having a secure lock through the use of the multiple rollers.

Side panel 20, as shown in FIG. 4, with longitudinal sides 21 and width sides 22 further comprises longitudinal ribs 23 and cross ribs 24 defining a plurality of parallelogram shaped sections 26. The longitudinal ribs 23 extend outwardly from the side panel 20, are parallel with each other, run from width side 22 to opposite width side 22 of the panel 20 and are parallel with the longitudinal sides 21. The cross ribs 24 extend outwardly from the panel 20, are parallel with each other, run from longitudinal side 21 to opposite longitudinal side 21 and are angled to intersect the longitudinal ribs 23 such that complementary acute and obtuse angles are formed at the intersection point 25. The combination of four intersection points, 25*a*, 25*b*, 25*c* and 25*d* then define the corners of a section 26 in the shape of a parallelogram. This rib arrangement is identical on the access doors.

This parallelogram shape serves to increase the circulation of the electroplating bath with the barrel when submerged in the electroplating tank. This circulation is then further increased by the arrangement of the elongated openings 27 within the parallelogram shaped section 26. This combination of longitudinal ribs 23 and cross ribs 24 enable the parallelogram shaped sections 26 defined by the rib structure to be very narrow.

Figure 3:
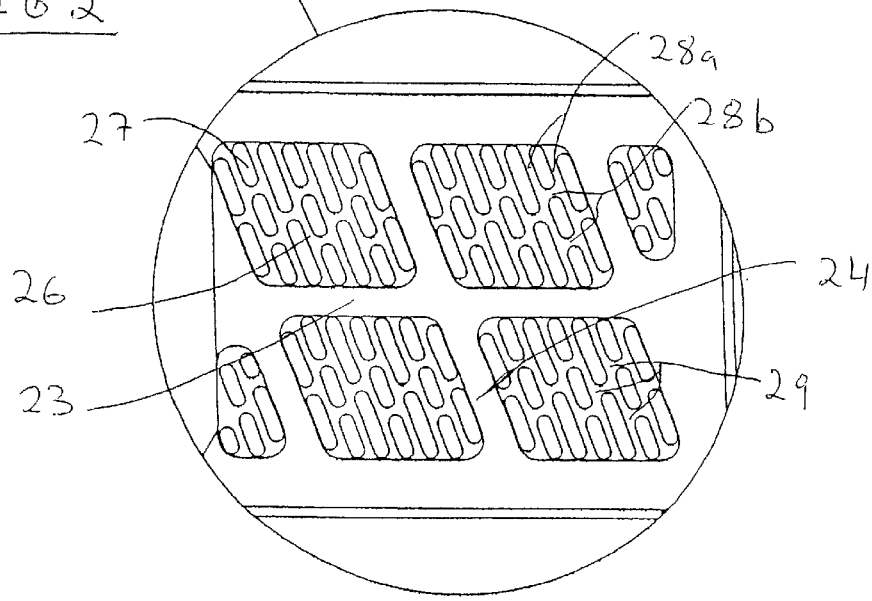
FIG. 3 is an enlarged view of section I of FIG. 2.

The parallelogram shaped section 26, as shown in detail in FIG. 3 from the access doors 41,42 and are identical on the side panel 20, further comprises a plurality of support segments 28 that define elongated openings 27 which allow the electroplating solution to pass into the barrel 8 while keeping any parts (not shown) being electroplated from falling out. These openings differ from openings known in the prior art by the fact that they are elongated without compromising strength and thus result in a greater open area both per each elongated opening 27 and per each section 26. This greater open area combined with the thin base allowed by the supporting rib structure allows the present barrel openings 27 to have a minimal capillary effect while still being strong enough to withstand the rigors of a manufacturing environment. The strength comes in part from the support segments 28 that define the elongated openings as differing sizes within the parallelogram shaped section aligned in rows of holes of uniform size as seen in FIG. 3.

In the preferred embodiment this arrangement of support segments defines the openings as running parallel with the angled cross ribs 24 as seen in FIG. 3. The support segments 28 comprise elongated segments 28*a* and cross segments 28*b*. The elongated segments 28*a* run parallel with the cross ribs 24. The cross segments 28*b* then interconnect the elongated segments 28*a* so that at each segment intersection point 29, the cross segment 28*b* ends and does not continue past the elongated segment 28*a*. These intersections define the boundaries of the elongated openings 27 through which the electroplating solution passes with minimal amounts of "drag-out" when the barrel is removed from the electroplating bath. These openings can either be of consistent length or varied length, with the preferred embodiment utilizing openings of varied length. The utilization of such larger openings than are known in the prior art allows the electroplating solution to pass quickly and efficiently into the barrel and a minimal capillary effect when the barrel is removed from the bath. In another embodiment this arrangement can also be formed by utilizing support segments 28 that define openings that run parallel to the longitudinal ribs 23.

The above has been offered for illustrative purposes only and is not intended to limit

I claim:

1. A rotatable electroplating barrel for plating parts having a pair of separate end plates, at least one access panel with a means for inserting and removing objects from the interior of said barrel and a plurality of perforated, separate side panels which permit passage of a bath solution into said barrel, wherein there is means for rotating said barrel, comprising:

at least one of said side panels having sections that are defined by a reinforcing rib structure;

said rib structure further is formed with an angular rib structure which is parallel in both directions such that each open section within said side panel is formed in a parallelogram configuration with outer boundaries defined by said intersecting rib structure which supports and strengthens the barrel and enables optimum flow of the electroplating solution;

said rib structure being made of longitudinal and cross ribs which intersect to form separate and perforated parallelogram sections such that intersecting rib segments intersect at a point between four adjacent parallelogram shaped sections;

wherein said parallelogram shaped sections further comprise:

elongated and cross support segments;

said elongated segments spanning the distance between said longitudinal ribs and running parallel with said cross ribs;

said cross support segments spanning the distance between and connecting said elongated segments;

said cross support segments and said elongated segments defining an elongated opening through which fluid can pass through said side panel.

2. A rotatable electroplating barrel for plating parts having a pair of separate end plates, at least one access panel with a means for inserting and removing objects from the interior of said barrel and a plurality of perforated, separate side panels which permit passage of a bath solution into said barrel, wherein there is means for rotating said barrel, comprising:

at least one of said side panels having sections that are defined by a reinforcing rib structure;

said rib structure further is formed with an angular rib structure which is parallel in both directions such that each open section section within said side panel is formed in a parallelogram configuration with outer boundaries defined by said intersecting rib structure which supports and strengthens the barrel and enables optimum flow of the electroplating solution;

said rib structure being made of longitudinal and cross ribs which intersect to form separate and perforated parallelogram sections such that intersecting rib segments intersect at a point between four adjacent parallelogram shaped sections;

wherein said parallelogram shaped sections further comprise:

elongated and cross support segments;

said elongated segments spanning the distance between said cross ribs and running parallel with said longitudinal ribs;

said cross support segments spanning the distance between and connecting said elongated segments;

said cross support segments and said elongated segments defining an opening an elongated opening through which fluid can pass through said side panel.

3. The barrel of claim 1 or claim 2 wherein the side panels, end plates, and door panel are made of a chemically inert durable plastic polymer material.

4. The barrel of claim 1 or claim 2 wherein the interior of the barrel forms a smooth surface.

5. The barrel of claim 1 or claim 2 wherein the side panels form the sidewalls of a hexagonal barrel.

6. The barrel of claim 1 or claim 2 wherein the side panels are separately mounted and fixably associated parallel to one another at the ends to form the barrel.

7. The barrel of claim 1 or claim 2 wherein said separate side panels are a solid fixed perpendicularly to the plurality of side panels which form the barrel.

8. A rotatable electroplating barrel for plating parts having a pair of end plates, at least one access panel with at least one removable door for inserting and removing said parts from the interior of said barrel and a plurality of perforated side panels which permit passage of a bath solution into said barrel, wherein there is means for rotating said barrel, comprising:

said removable door having top and bottom surfaces with first and second length sides and first and second width sides with said length sides being longer than said width sides and a height between said top and bottom surfaces;

a crossbar further comprising an elongated bar having top and bottom surfaces with first and second length sides and first and second width sides with said length sides longer than said width side of removable door but shorter than said length side of removable door and a width side shorter than the width side of said removable door and having a connection point centered equally between said first and second length sides and said first and second width sides;

a plurality of spherical rollers having a diameter less than said height of said removable door;

said top surface of said removable door further comprising a plurality of annular indentations equally spaced from a point centered between said first and second width sides of said removable door, said indentations equally spaced from each other;

said annular indentations of said removable door having a depth greater than one-half of said diameter of spherical roller and a circumference complimentary to said diameter of spherical roller;

said bottom surface of said crossbar further comprising a plurality of annular indentations equally spaced from a point centered between said first and second width sides of crossbar, said indentations equally spaced from each other;

said annular indentations of said removable door having a depth greater than one-half of said diameter of spherical roller and a circumference complimentary to said diameter of said spherical roller;

said crossbar attached at said connection point to a point centered between said first and second width sides of said removable door by spring means whereby said cross bar can be lifted and rotated around said connection point.

9. The electroplating barrel of claim 8 further comprising:

at least one of said side panels having sections that are defined by a reinforcing rib structure;

said rib structure further is formed with an angular rib structure which is parallel in both directions such that each open section within said side panel is formed in a parallelogram configuration with outer boundaries defined by said intersecting rib structure which supports and strengthens the barrel and enables optimum flow of the electroplating solution;

said rib structure being made of longitudinal and cross ribs which intersect to form separate and perforated parallelogram sections such that intersecting rib segments intersect at a point between four adjacent parallelogram shaped sections;

said parallelogram shaped sections further having elongated and cross support segments;

said elongated segments spanning the distance between said longitudinal ribs and running parallel with said cross ribs;

said cross support segments spanning the distance between and connecting said elongated segments;

said cross support segments and said elongated segments defining an elongated opening through which fluid can pass through said side panel.

* * * * *